US009443362B2

(12) United States Patent
Singh

(10) Patent No.: US 9,443,362 B2
(45) Date of Patent: Sep. 13, 2016

(54) COMMUNICATION AND PROCESSING OF CREDENTIAL DATA

(71) Applicant: ASSA ABLOY AB, Stockholm (SE)

(72) Inventor: Sona Singh, Taby (SE)

(73) Assignee: ASSA ABLOY AB (SE)

( * ) Notice: Subject to any disclaimer, the term of this patent is extended or adjusted under 35 U.S.C. 154(b) by 118 days.

(21) Appl. No.: 14/057,271

(22) Filed: Oct. 18, 2013

(65) Prior Publication Data

US 2015/0109098 A1 Apr. 23, 2015

(51) Int. Cl.
*E05B 35/00* (2006.01)
*G07C 9/00* (2006.01)

(52) U.S. Cl.
CPC ..... *G07C 9/00111* (2013.01); *G07C 9/00103* (2013.01); *G07C 9/00571* (2013.01); *G07C 2009/00793* (2013.01)

(58) Field of Classification Search
CPC ..... G06K 7/08; G05B 19/00
See application file for complete search history.

(56) References Cited

U.S. PATENT DOCUMENTS

| | | | |
|---|---|---|---|
| 4,727,368 | A | 2/1988 | Larson et al. |
| 5,204,663 | A | 4/1993 | Lee |
| 5,678,200 | A | 10/1997 | Levi |
| 5,903,845 | A | 5/1999 | Buhrmann et al. |
| 6,095,416 | A | 8/2000 | Grant et al. |
| 6,216,227 | B1 | 4/2001 | Goldstein |
| 6,257,486 | B1 | 7/2001 | Teicher et al. |
| 6,374,356 | B1 | 4/2002 | Daigneault et al. |
| 6,577,299 | B1 | 6/2003 | Schiller et al. |
| 6,624,739 | B1 | 9/2003 | Stobbe |
| 6,668,322 | B1 | 12/2003 | Wood et al. |
| 6,719,200 | B1 | 4/2004 | Wiebe |
| 6,766,450 | B2 | 7/2004 | Micali |
| 6,859,650 | B1 | 2/2005 | Ritter |

(Continued)

FOREIGN PATENT DOCUMENTS

| | | |
|---|---|---|
| EP | 0829828 | 3/1998 |
| EP | 1103922 | 5/2001 |

(Continued)

OTHER PUBLICATIONS

Esato—"Nokia Launches NFC Shell for Mobile Payments" http://www.esato.com/news/article.php/id=436 (Feb. 25, 2005) (3 pages).

(Continued)

*Primary Examiner* — Jennifer Mehmood
*Assistant Examiner* — Pameshanand Mahase
(74) *Attorney, Agent, or Firm* — Sheridan Ross P.C.

(57) ABSTRACT

Credential data representing users seeking access to a well-defined space are registered in a reader unit associated with an access-control-related building component. A linked address associates the credential data with a first credential data receiver (EAC1) and/or at least one second credential data receiver (EAC2). The address is stored in a memory at the reader unit or on a portable carrier holding the credential data. If the address identifies the first credential data receiver (EAC1), the reader unit forwards the registered credential data to this unit (EAC1). If the address (A) identifies a particular second credential data receiver (EAC2), the reader unit instead forwards the registered credential data (CD) to this unit (EAC2). When receiving the credential data, the units (EAC1; EAC2) effect at least one decision concerning the well-defined space independently of one another.

17 Claims, 4 Drawing Sheets

(56) References Cited

U.S. PATENT DOCUMENTS

| | | | | |
|---|---|---|---|---|
| 6,895,234 | B1 | 5/2005 | Laursen et al. | |
| 7,012,503 | B2 | 3/2006 | Nielsen | |
| 7,114,179 | B1 | 9/2006 | Ritter et al. | |
| 7,190,948 | B2 | 3/2007 | Donley et al. | |
| 7,197,767 | B2 | 3/2007 | Kusakabe et al. | |
| 7,205,882 | B2 | 4/2007 | Libin | |
| 7,308,254 | B1 | 12/2007 | Rissanen | |
| 7,363,252 | B2 | 4/2008 | Fujimoto | |
| 7,376,839 | B2 | 5/2008 | Carta et al. | |
| 7,380,279 | B2 | 5/2008 | Prokupets et al. | |
| 7,600,129 | B2 | 10/2009 | Libin et al. | |
| 7,616,091 | B2 | 11/2009 | Libin | |
| 7,698,566 | B1 | 4/2010 | Stone | |
| 7,706,778 | B2 | 4/2010 | Lowe | |
| 7,716,486 | B2 | 5/2010 | Libin et al. | |
| 7,730,126 | B2 | 6/2010 | Crawford | |
| 7,775,429 | B2 | 8/2010 | Radicella et al. | |
| 7,822,989 | B2 | 10/2010 | Libin et al. | |
| 7,823,193 | B2 | 10/2010 | Ritter et al. | |
| 7,873,989 | B2 | 1/2011 | Karkas et al. | |
| 8,150,374 | B2 | 4/2012 | Lowe | |
| 8,572,705 | B2 | 10/2013 | Ritter et al. | |
| 8,578,472 | B2 | 11/2013 | Davis et al. | |
| 2001/0018660 | A1 | 8/2001 | Sehr | |
| 2003/0151493 | A1 | 8/2003 | Straumann et al. | |
| 2003/0189096 | A1* | 10/2003 | Markkanen et al. | 235/451 |
| 2003/0190887 | A1 | 10/2003 | Hook et al. | |
| 2003/0216143 | A1 | 11/2003 | Rose et al. | |
| 2004/0039916 | A1 | 2/2004 | Aldis et al. | |
| 2004/0050930 | A1 | 3/2004 | Rowe | |
| 2004/0059590 | A1 | 3/2004 | Mercredi et al. | |
| 2004/0078594 | A1 | 4/2004 | Scott | |
| 2004/0130437 | A1 | 7/2004 | Stevens | |
| 2004/0167881 | A1 | 8/2004 | Masuka | |
| 2004/0177270 | A1 | 9/2004 | Little et al. | |
| 2005/0055562 | A1 | 3/2005 | Guthery | |
| 2005/0149443 | A1 | 7/2005 | Torvinen | |
| 2005/0178833 | A1 | 8/2005 | Kisliakov | |
| 2005/0271250 | A1 | 12/2005 | Vallone et al. | |
| 2006/0049255 | A1 | 3/2006 | von Mueller et al. | |
| 2006/0052091 | A1 | 3/2006 | Onyon et al. | |
| 2006/0164235 | A1 | 7/2006 | Gounder | |
| 2006/0165060 | A1 | 7/2006 | Dua | |
| 2006/0170533 | A1 | 8/2006 | Chioiu et al. | |
| 2006/0182661 | A1 | 8/2006 | Aquila | |
| 2007/0067400 | A1* | 3/2007 | Kawakami et al. | 709/206 |
| 2008/0107269 | A1 | 5/2008 | Gehrmann et al. | |
| 2008/0163361 | A1* | 7/2008 | Davis et al. | 726/19 |
| 2008/0211620 | A1 | 9/2008 | Willgert | |
| 2009/0183541 | A1 | 7/2009 | Sadighi et al. | |
| 2009/0259838 | A1* | 10/2009 | Lin | H04L 9/3271 713/150 |
| 2010/0042954 | A1 | 2/2010 | Rosenblatt et al. | |
| 2010/0106773 | A1* | 4/2010 | Tsutazawa et al. | 709/203 |
| 2010/0245033 | A1* | 9/2010 | Sasakuma | 340/5.2 |
| 2011/0093928 | A1 | 4/2011 | Nakagawa et al. | |
| 2011/0187493 | A1* | 8/2011 | Elfstrom et al. | 340/5.6 |
| 2012/0114122 | A1 | 5/2012 | Metivier | |
| 2012/0157058 | A1 | 6/2012 | Lowe | |
| 2012/0278901 | A1 | 11/2012 | Bunter | |
| 2013/0093563 | A1 | 4/2013 | Adolfsson et al. | |
| 2014/0013418 | A1 | 1/2014 | Davis et al. | |
| 2014/0025408 | A1 | 1/2014 | Ritter et al. | |
| 2014/0123317 | A1* | 5/2014 | Sugihara | 726/28 |
| 2015/0213247 | A1 | 7/2015 | Davis et al. | |
| 2015/0213248 | A1 | 7/2015 | Davis et al. | |
| 2015/0215322 | A1 | 7/2015 | Davis et al. | |
| 2015/0220711 | A1 | 8/2015 | Lowe | |
| 2015/0220721 | A1 | 8/2015 | Davis et al. | |
| 2015/0220722 | A1 | 8/2015 | Davis et al. | |
| 2015/0222613 | A1 | 8/2015 | Lowe | |
| 2015/0222622 | A1 | 8/2015 | Lowe | |
| 2015/0222623 | A1 | 8/2015 | Lowe | |
| 2015/0223066 | A1 | 8/2015 | Lowe | |
| 2015/0223067 | A1 | 8/2015 | Lowe | |

FOREIGN PATENT DOCUMENTS

| | | |
|---|---|---|
| EP | 1333409 | 8/2003 |
| EP | 1562153 | 8/2005 |
| EP | 1628255 | 2/2006 |
| EP | 1841166 | 10/2007 |
| FR | 2839833 | 11/2003 |
| JP | 2002-129792 | 5/2002 |
| KR | 10-2004-032311 | 4/2004 |
| WO | WO 02/096070 | 11/2002 |
| WO | WO 03/081934 | 10/2003 |
| WO | WO 2004/025545 | 3/2004 |
| WO | WO 2005/024549 | 3/2005 |
| WO | WO 2005/038728 | 4/2005 |
| WO | WO 2005/091516 | 9/2005 |
| WO | WO 2005/096651 | 10/2005 |
| WO | WO 2007/126375 | 11/2007 |
| WO | WO 2007/139909 | 12/2007 |
| WO | WO 2008/024162 | 2/2008 |
| WO | WO 2008/024320 | 2/2008 |
| WO | WO 2008/035115 | 3/2008 |
| WO | WO 2008/042302 | 4/2008 |

OTHER PUBLICATIONS

Indala—"Product Families" www.indala.com/products/index.html (Copyright 2004) (2 pages).

NFC Forum—"About Near Field Communication" http://www.nfc-forum.org/aboutnfc/ (Copyright 2005) (3 pages).

Nokia—"Use Cases" http://www.nokia.com (Copyright 2005) (2 pages).

Phillips Semiconductoers—"Near Field Communication PN511-Transmision module." (Feb. 2004) (18 pages).

* cited by examiner

COMMUNICATION AND PROCESSING OF CREDENTIAL DATA

THE BACKGROUND OF THE INVENTION AND PRIOR ART

The present invention relates generally to solutions for handling credential data in an efficient manner, for example in connection with access control. More particularly the invention relates to a reader unit configured to register credential data in respect of users seeking access to a well-defined space, communicate with an access-control-related building component associated with the well-defined space, and communicate with a first credential data receiver for causing at least one access decision in respect of the well-defined space to be effected; a data communication system comprising the proposed reader unit, an access-control-related building component associated with the reader unit and the well-defined space, and a first credential data receiver configured to receive credential data registered by the reader unit and in response thereto cause at least one access decision in respect of the well-defined space to be effected; and a method of communicating data in a network comprising: registering credential data in a reader unit, the credential data representing users seeking access to a well-defined space associated to the reader unit, forwarding any registered credential data to a credential data receiver and in response thereto effecting at least one access decision in respect of the well-defined space.

In modern buildings, especially in business premises, electronic access control (EAC) systems are often used to control entries to and exits from various facilities. Here, personal so-called credential data are normally used as a basis to define which subjects who are authorized to enter a certain area during a given interval of time. The credential data may be embodied in a key fob, a smartcard, a proximity card or other appropriate carrier, e.g. a subscriber identity module (SIM) card of a mobile telephone or a personal digital assistant (PDA).

A reader unit, for instance of short-range radio communication type, can be employed to register the credential data and forward the data to an access control node. In this context, the short-range radio communication type of interface is understood to adhere a known wireless protocol, e.g. the NFC (Near Field Communication) protocol, Bluetooth ZigBee or WiFi. Provided that the credential data are found to represent an authorized subject, the access control node causes an access message to be sent to a control mechanism of a door associated with the reader, for instance via a UART protocol (UART=Universal Asynchronous Receiver/Transmitter), resulting in that the door opens.

US 2008/0163361 describes a solution, for providing a secure access network. Here, access decisions are made by a portable credential using data and algorithms stored on the credential. Since access decisions are made by the portable credential non-networked hosts or local hosts can be employed that do not necessarily need to be connected to a central access controller or database thereby reducing the cost of building and maintaining the secure access network.

US 2011/0187493 discloses a system, wherein access is controlled within a multi-room facility. A guest of the multi-room facility is here allowed to remotely confirm reservations to the facility as well as bypass the front desk of the multi-room for check-in purposes. At a location within the facility, the guests are allowed to confirm their arrival, check-in, and have their access credential written with personalized access data that may be useable for the duration of the guest's stay.

PROBLEMS ASSOCIATED WITH THE PRIOR ART

Consequently flexible access solutions are known. However, there is yet no efficient system enabling different enterprises/organizations to share one or more automatic doors (or other access related components) of a building without requiring a central control function for said one or more doors/components, which is common for all organizations.

SUMMARY OF THE INVENTION

The object of the present invention is therefore to solve the above problem, and thus offer flexible and efficient solution that enables different enterprises/organizations to conveniently share one or more automatic doors (or other access related components).

According to one aspect of the invention, the object is achieved by the initially described reader unit, wherein the reader unit is configured to communicate with at least one second credential data receiver for causing at least one access decision in respect of the well-defined space to be effected. The reader unit is further configured to forward each registered piece of credential data to either the first credential data receiver or to a particular one of the at least one second credential data receiver based on an address linked to the piece of credential data. The linked address identifies the first credential data receiver or the particular one of the at least one second credential data receiver. The linked address (preferably of Internet-Protocol type), in turn, is stored in either a memory module associated with the reader unit; or on a carrier (e.g. a card) holding the piece of credential data, which carrier is configured to be presented to the reader unit for registering the piece of credential data.

This reader unit is advantageous because it renders it possible for different enterprises and organizations to control various access-related components independently of one another while sharing a common reader unit.

According to another aspect of the invention, the object is achieved by the data communication system described initially, wherein the data communication system includes at least one second credential data receiver configured to receive credential data registered by the reader unit, and in response thereto cause at least one access decision in respect of the well-defined space to be effected. Moreover, the reader unit is communicatively connected to the first credential data receiver and the at least one second credential data receiver. The reader unit is further configured to forward a registered piece of credential data to either the first credential data receiver or a particular one of the at least one second credential data receiver based on an address linked to the piece of credential data, which address identifies the first credential data receiver or the particular one of the at least one second credential data receiver. The linked address, in turn, is stored in a memory module associated with the reader unit, or on a carrier holding the piece of credential data, which carrier is configured to be presented to the reader unit for registering the piece of credential data. The advantages of this system are the same as those associated with the above-proposed reader unit.

According to one preferred embodiment of this aspect of the invention, the at least one access decision involves granting or refusing access to the well-defined space. Here, the access-control-related building component includes a lock mechanism configured to selectively enable or prevent access to the well-defined space via a door associated with the reader unit. In response to a received piece of credential data, each of the first and the at least one second credential data receiver is configured to check the piece of credential data against a database defining a set of users' access rights to the well-defined space. If the piece of credential data is found to designate an authorized user, the credential data receivers are configured to cause an access grant message to be sent to the lock mechanism, which access grant message orders the lock mechanism to open the door. Otherwise, i.e. if the user is found not to be authorized, the credential data receivers are configured to refrain from causing the access grant message to be sent to the lock mechanism. Hence, the access to a building, or part thereof, can be controlled in a very convenient and efficient manner.

According to another preferred embodiment of this aspect of the invention, the at least one access decision involves registering an entry to or exit from the well-defined space. Here, in response to a received piece of credential data, each of the first and the at least one second credential data receiver is configured to: register an entry if the piece of credential data is received via a first scanner of the reader unit, and register an exit if the piece of credential data is received via a second scanner of the reader unit. Thus, a digital puncher/time-clock can be conveniently implemented.

According to a further preferred embodiment of this aspect of the invention, the data communication system includes a control node that is communicatively connected to the reader unit and each of the first and the at least one second credential data receiver. The control node is configured to receive credential data from the reader unit, and forward the received credential data to a credential data receiver identified by the address linked to the credential data. The control node is also configured to receive access grant messages from the first and the at least one second credential data receiver; and forward the received access grant messages to the lock mechanism. Each access grant message is here configured to order the lock mechanism to be opened during a predetermined interval, for example to allow a person to pass through a door. This enables a highly efficient implementation of an automatic door or similar function.

According to yet another preferred embodiment of this aspect of the invention, the control node is communicatively connected to at least one reader unit in addition to said reader unit. The control node is further configured to receive credential data from the additional reader unit, forward the received credential data to a credential data receiver identified by the address linked to the credential data, receive access grant messages from the first and the at least one second credential data receiver, and forward the received access grant messages to a lock mechanism in addition to said lock mechanism. Also here each access grant message is configured to order the additional lock mechanism to be opened during a predetermined interval. Thus, the control node can control multiple lock mechanisms in a straightforward and efficient manner.

Preferably, the linked addresses identifying the first and the at least one second credential data receivers are Internet Protocol addresses.

According to another aspect of the invention, the object is achieved by the method described initially, wherein it is presumed that the network includes a first credential data receiver and at least one second credential data receiver. The method involves forwarding each registered piece of credential data to either the first credential data receiver, or a particular one of the at least one second credential data receiver based on an address linked to the piece of credential data, which address identifies the first credential data receiver or the particular one of the at least one second credential data receiver. The linked address, in turn, is stored in a memory module associated with the reader unit, or on a carrier holding the piece of credential data, which carrier is configured to be presented to the reader unit for registering the piece of credential data. The advantages of this method, as well as the preferred embodiments thereof, are apparent from the discussion above with reference to the proposed reader unit and data communication system.

According to a further aspect of the invention the object is achieved by a computer program product, which is loadable into the memory of a computer, and includes software for performing the steps of the above proposed method when executed on a computer.

According to another aspect of the invention the object is achieved by a computer readable medium, having a program recorded thereon, where the program causes a computer to perform the method proposed above when the program is loaded into the computer.

Further advantages, beneficial features and applications of the present invention will be apparent from the following description and the dependent claims.

BRIEF DESCRIPTION OF THE DRAWINGS

The invention is now to be explained more closely by means of preferred embodiments, which are disclosed as examples, and with reference to the attached drawings.

DESCRIPTION OF PREFERRED EMBODIMENTS OF THE INVENTION

Figure 1:
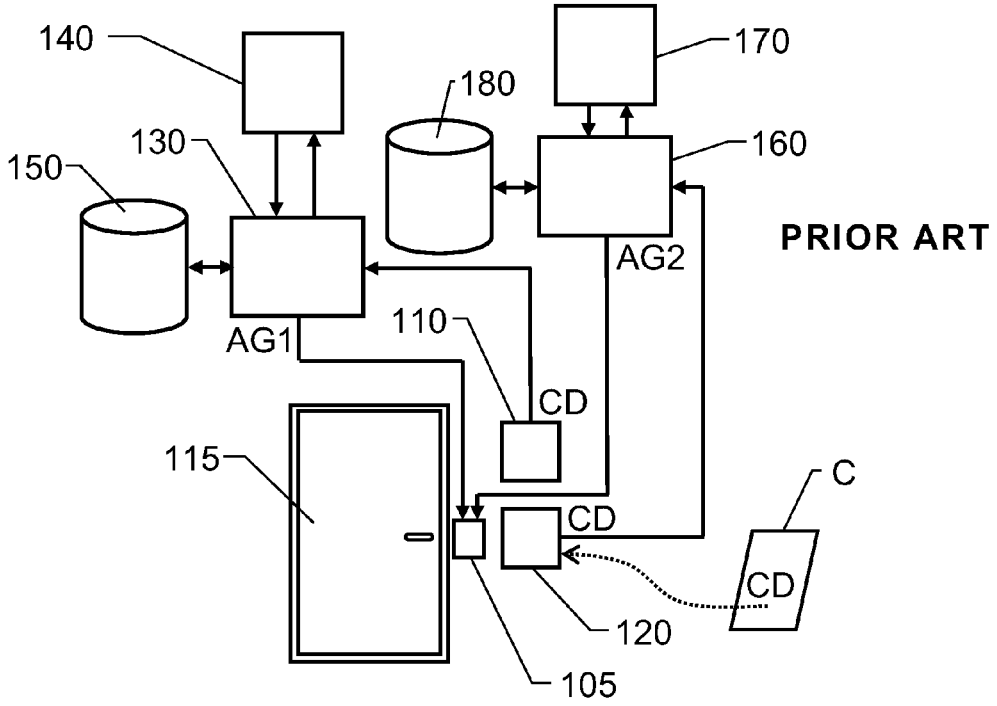
FIG. 1 shows a block diagram over a prior-art access control system.

Initially, we refer to FIG. 1 showing a block diagram over a prior-art access control system. Here, first and second readers, 110 and 120, are connected to a first and a second control panel 130 and 160 respectively. Each reader 110 and 120 is arranged to control entries via a door 115 based on communication with the control panels 130 and 160.

The first control panel 130, in turn, is controlled by a first EAC node 140 and based on entries in a first database 150 associated with the first control panel 130. More precisely, when a first user approaches the door 115 and presents a credential data carrier C (e.g. in the form of a proximity card, a key fob, a smartcard, or other appropriate carrier, such as a subscriber identity module (SIM) card of a mobile telephone or a personal digital assistant (PDA)) to a given reader, say a first reader 110, this reader 110 reads out the credential data CD from the data carrier C and forwards the credential data CD to the first control panel 130. Then, the first control panel 130 checks the first database 150 for any entries matching the credential data CD. If a match is found, the first control panel 130 queries the first EAC node 140 to determine whether or not the first user (i.e. the person being associated with the credential data CD) shall be allowed to enter through the door 115. Given that the first user is found to be authorized, the first control panel 130 sends a first access grant message AG1 (for instance via a UART protocol) to a lock control mechanism 105 at the door 115. In response to the first access grant message AG1 the lock control mechanism 105 unlocks the door 115, so that the first user can enter.

We can assume that each of a first and second organization controls the door 115, and that the above-mentioned first user belongs to the first organization. When a second user belonging to the second organization approaches the door 115 in order to enter, he/she presents his/her credential data carrier C to the second reader 120. The second reader 120 reads out the credential data CD from the data carrier C and forwards this data to the second control panel 160. Then, the second control panel 160 checks a second database 180 for any entries matching the second user's credential data CD. If a match is found, the second control panel 160 queries a second EAC node 170 to determine whether or not the second user shall be allowed to enter through the door 115. Given that the second user is found to be authorized, the second control panel 160 sends a second access grant message AG2 to the lock control mechanism 105, which in response thereto, unlocks the door 115, so that the second user can enter.

As can be seen in FIG. 1, each organization that wishes to control entries (and/or exits) via a given door needs to arrange a respective reader unit at this door and build up an entire communication structure of its own to control the door's lock mechanism. Consequently, if many organizations are involved, a large amount of hardware is required, for instance in the form of reader units at the door. Moreover, sharing control panels, EAC nodes and/or databases between organizations is undesired for many reasons, for example referring to security/integrity risks and administration.

Figure 2:
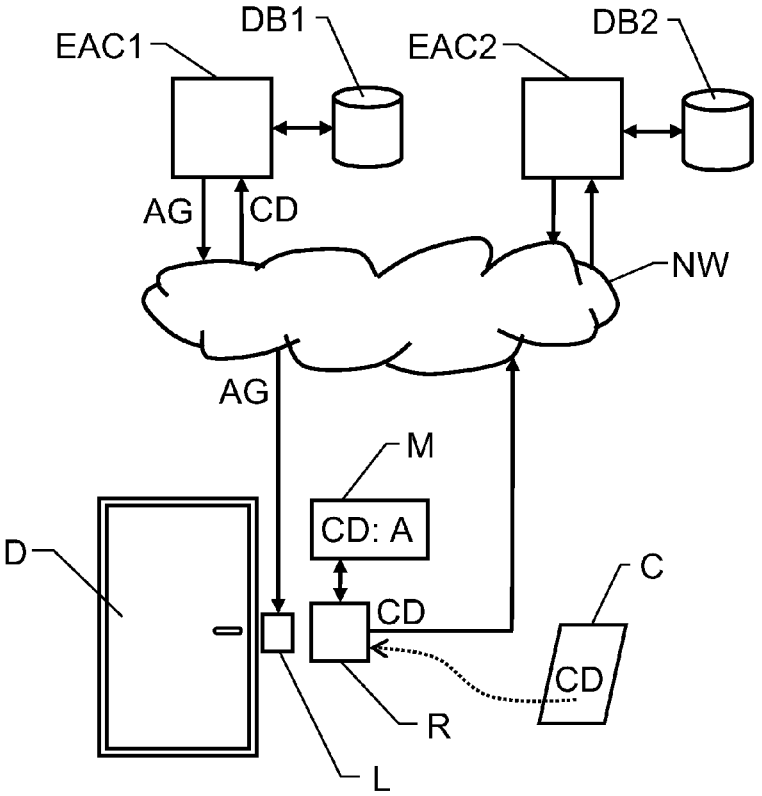
FIGS. 2-6 show block diagrams over data communication systems according to various embodiments of the invention.

Such problems, however, can be avoided by the present invention. FIG. 2 shows a block diagram over a data communication system according to a first embodiment of the invention.

Here, a reader unit R is associated with a door D through which users may gain access to a well-defined space. The reader unit R is configured to register user credential data CD, which may be stored on a personal carrier C embodied in a key fob, a smartcard, a proximity card or any other appropriate carrier, e.g. a SIM card of a mobile telephone or a PDA.

The system includes a first credential data receiver EAC1 and at least one second credential data receiver EAC2, where the first credential data receiver EAC1 may be controlled by a first organization and the at least one second credential data receiver EAC2 may be controlled by a respective organization different from the first organization. For clarity reasons, however, in the following description, we will only refer to one second credential data receiver EAC2.

Analogous to the above example, a user seeking access to the well-defined space is expected present his/her carrier C for the reader unit R, and in response thereto, the reader unit R is configured to register the credential data CD on the carrier C. Here, since there are more than one control node, the reader unit R is configured to communicate with both the first and the second credential data receiver EAC1 and EAC2, preferably via a general communication network NW, such as the Internet. In each individual case, however, the reader unit R is configured to forward the registered credential data CD to exactly one of the first credential data receiver EAC1 or the second credential data receiver EAC2.

According to the invention, each piece of credential data CD is linked to an address A, which identifies either the first credential data receiver EAC1 or the second credential data receiver EAC2 (or in the general case, a particular one of the at least one second credential data receiver EAC2). The linked address A, preferably an Internet Protocol address, is stored either in a memory module M associated with the reader unit R (as shown in FIG. 1), or on the carrier C holding the piece of credential data CD (as will be described below with reference to FIGS. 3*a*, 3*b* and 6).

In the example illustrated in FIG. 2, we assume that access decisions generated by the system involve granting or refusing access to the well-defined space, i.e. that an access-control-related building component comprises a lock mechanism L configured to selectively enable or prevent access to a well-defined space via a door D that is associated with a reader unit R. In the specific example shown in FIG. 2, it is further assumed that the address A linked to the credential data CD identifies the first credential data receiver EAC1. Therefore, the credential data CD are sent, via the communication network NW, to the first credential data receiver EAC1. Here, the credential data CD are checked against a first database DB1 to determine whether or not the user associated with the credential data CD is authorized to enter the door D at the current point in time. If so, the first credential data receiver EAC1 forwards an access grant message AG to a lock control mechanism L, which in response thereto, unlocks the door D, so that the user can enter the door D.

Similarly, if a carrier C is presented for the reader unit R, which carrier C contains credential data CD linked to an address A identifying the second credential data receiver EAC2, the credential data CD are forwarded to the second credential data receiver EAC2 for verification against a second database DB2.

Figure 3A:
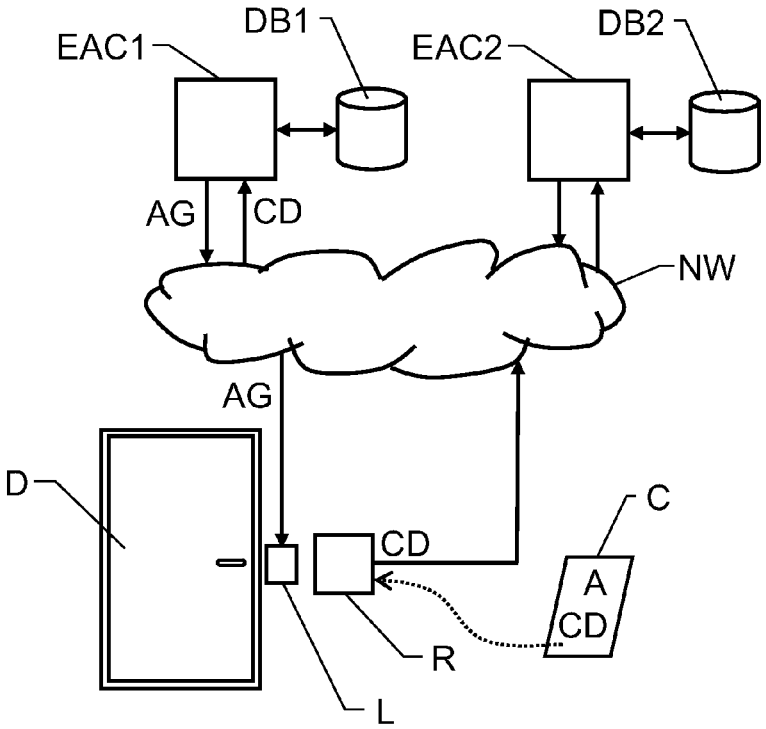

FIG. 3*a* shows a block diagram over a data communication system according to a second embodiment of the invention. Here, all units, components, signals and messages that also occur in FIG. 2 represent the same units, components, signals and messages as described above with reference to FIG. 2. As can be seen, in FIG. 3*a*, there is no memory module M associated with the reader unit R. Instead, each carrier C contains the address A being linked to the credential data CD. Thus, upon presentation of the carrier C for the reader unit R, the reader unit R is configured to read out the credential data CD as well as the address A linked thereto. Based on this address A, in turn, the reader unit R is configured to send the credential data CD to the credential data receiver identified by the address A, which in this example likewise is the first credential receiver EAC1. Then, the first credential receiver EAC1 executes the above-described verification procedure, and if the credential data CD are found to correspond to an authorized user, an access grant message AG is issued in response to which the lock L is caused to be unlocked. Otherwise, i.e. if the piece of credential data CD are found not to designate an authorized user, the first credential receiver EAC1 refrains from causing the access grant message AG to be sent to the lock mechanism L, and the lock mechanism L remains locked.

Figure 3B:
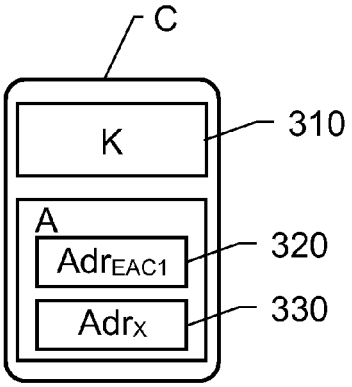

FIG. 3*b* shows an example of how the data content of the carrier C in FIG. 3*a* may be organized according one embodiment of the invention. Here, a storage area 310 contains a general encryption key K, which is required in the reader unit R to gain access to the contents of the carrier C. The address A, in turn, contains a first address field 310, which includes an address $Adr_{EAC1}$ to the first credential receiver EAC1; and a second address field 320 which includes another address $Adr_X$. This address may specify a different credential receiver being responsible for controlling another door. However, the second address field 320 may equally well be used for purposes completely unrelated to locking/unlocking of a door, e.g. registering the presence of a user. Each of the overall address A and the individual address fields 310 and 320 is preferably protected by a respective encryption key, such that only authorized entities can gain access to the data therein.

Figure 4:
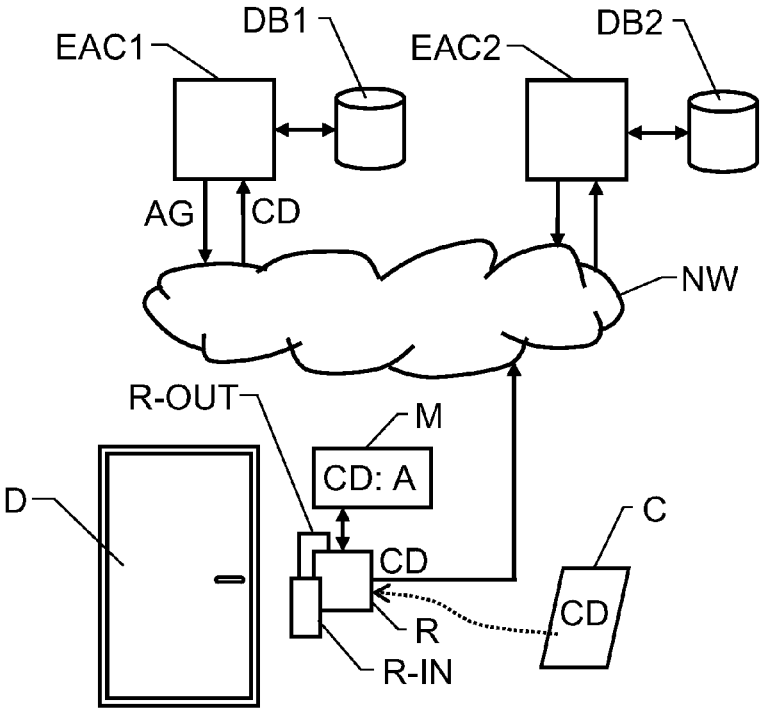

FIG. 4 shows a block diagram over a data communication system according to a third embodiment of the invention. Here, all units, components, signals and messages that also occur in either of FIG. 2 or 3 represent the same units, components, signals and messages as described above with reference to FIG. 2 or 3.

In the data communication system of FIG. 4, the access decisions involve registering entries to or exits from a well-defined space. I.e. the system may implement a digital puncher/time-clock. To this aim, the reader unit R contains a first scanner R-IN and a second scanner R-OUT, which are arranged on the inside and the outside respectively of the door D.

Moreover, each of the first and second credential data receivers EAC1 and EAC2 is configured to register an entry into the well-defined space in respect of a user associated with a given piece of credential data CD if the piece of credential data CD is received via a first scanner R-IN of the reader unit R, and register an exit out from the well-defined space in respect of the user if the piece of credential data CD is received via a second scanner R-OUT. Analogous to the above, in response to a received piece of credential data CD, the reader unit R is configured to send the piece of credential data CD to the first credential data receiver EAC1 if the address A linked thereto identifies the first credential data receiver EAC1, and to the second credential data receiver EAC2 if the linked address A identifies the second credential data receiver EAC2.

Figure 5:
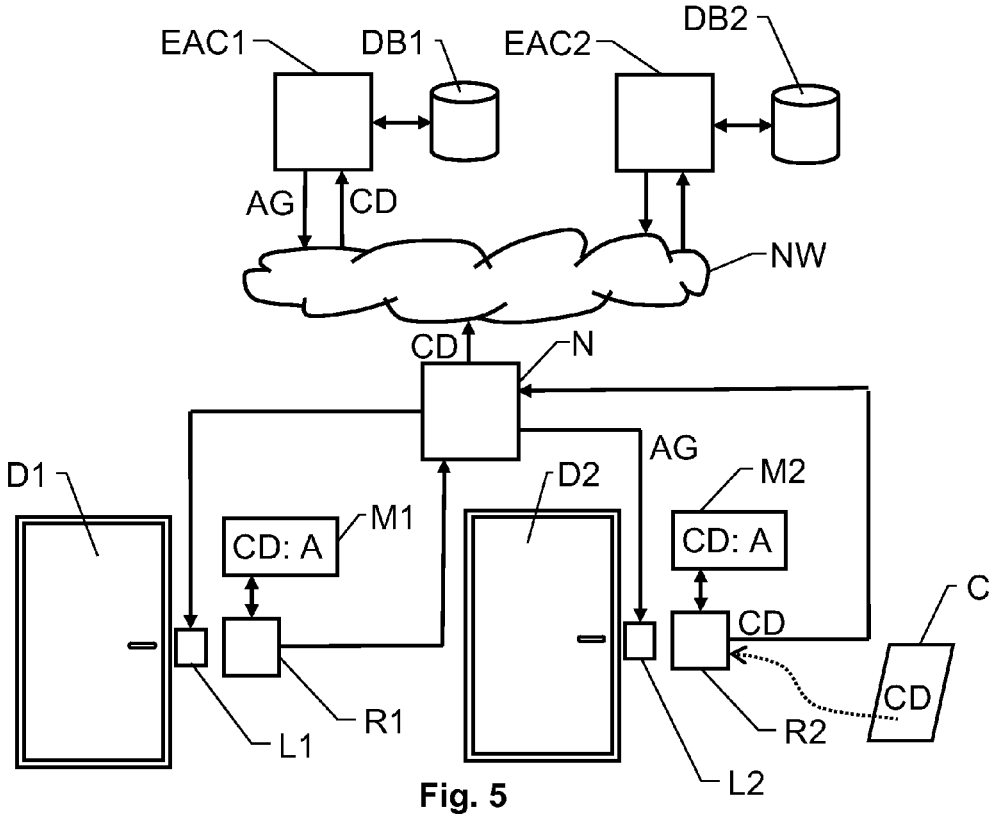
Figure 6:
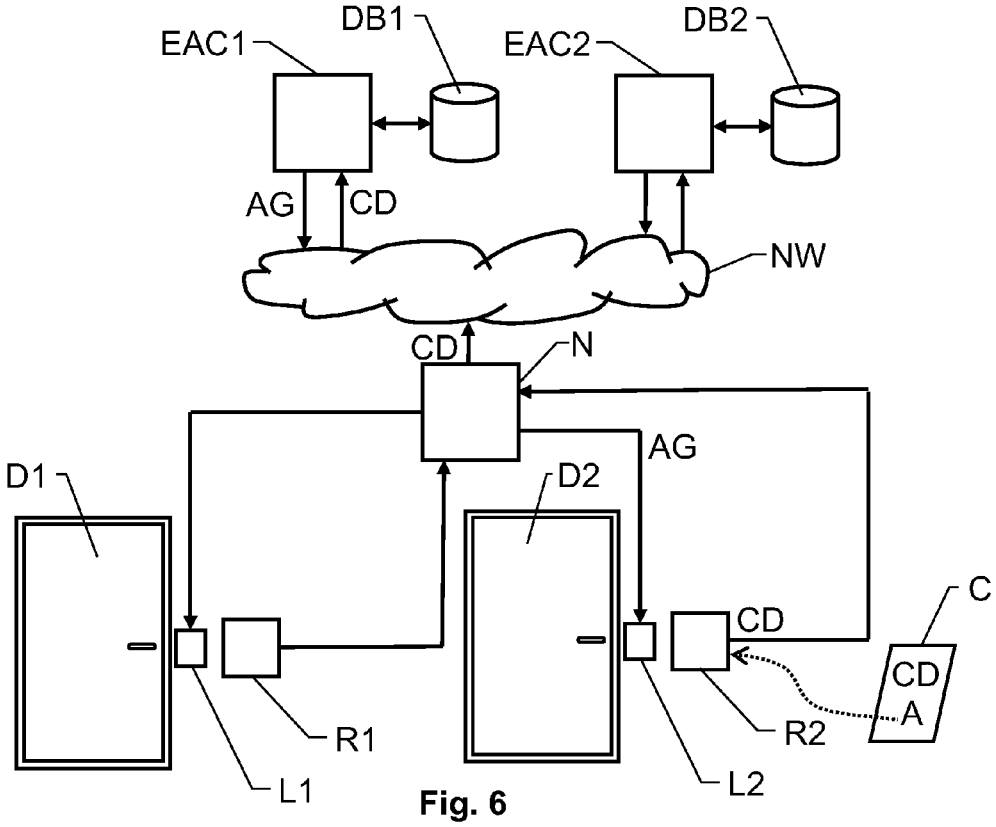

FIGS. 5 and 6 show block diagrams over data communication systems according to a fourth and fifth embodiment respectively of the invention, both in which the access decisions involve granting or refusing access to well-defined spaces via doors D1 and D2 controllable via lock mechanisms L1 and L2 to which a respective reader unit R1 and R2 is associated.

Again, all units, components, signals and messages that also occur in either of FIGS. 2 to 4 represent the same units, components, signals and messages as described above with reference to FIGS. 2 to 4.

In the system of FIG. 5, the addresses A linked to the credential data CD are stored in a memory module M (analogous to FIGS. 2 and 4), whereas in the system of FIG. 6 the linked addresses are stored on the carriers C (analogous to FIG. 3), otherwise the systems in FIGS. 5 and 6 are identical.

Inter alia, both systems contain a control node N, which is communicatively connected to a first reader unit R1 associated with a first door D1. The control node N is also communicatively connected to a second reader unit R2 associated with a second door D2 and, via a communication network NW, communicatively connected to each of a first and second credential data receiver EAC1 and EAC2 respectively. The control node N is configured to receive credential data CD from the reader units R1 and R2, and forward the received credential data CD to the credential data receiver EAC1 or EAC2 identified by the address A linked to the credential data CD.

The control node N is further configured to receive access grant messages AG from the first and second credential data receiver EAC1 and EAC2, and forward the received access grant messages AG to either a first lock mechanism L1 associated with the first door D1 or a second lock mechanism L2 associated with the second door D2 depending on from which reader unit R1 or R2 the credential data CD originated. As mentioned above, each access grant message AG is configured to order the lock mechanism L1 or L2 to be opened during a predetermined interval.

Naturally, according to the invention, the control node N may be configured to handle any other number of well-defined spaces and credential data receivers than two, i.e. from one and up. It should also be noted that the number of well-defined spaces (doors) and the number of credential data receivers need not be identical. On the contrary, it may very well be the case that the number of well-defined spaces (doors) is relatively large while the number of the credential data receivers is relatively small, say two; or vice versa, that the number of the credential data receivers is relatively large while the number of well-defined spaces is just one or two.

In any case, upon presentation of a piece of credential data CD to one of the reader units R1 or R2, this reader unit is configured to forward the piece of credential data CD to the credential data receiver EAC1 or EAC2 identified by the address A linked to the piece of credential data CD. Then, in response to a received piece of credential data CD, each of the first and the at least one second credential data receiver EAC1 and EAC2 is configured to check the piece of credential data CD against a database DB1 or DB2 respectively defining a set of users' access rights to the well-defined space behind the door D1 or D2 to which the reader unit R1 or R2 is associated by which the piece of credential data CD was registered. If the piece of credential data CD is found to designate an authorized user, the credential data receiver EAC1 or EAC2 is configured to cause an access grant message AG to be sent to the lock mechanism L1 or L2 ordering the lock mechanism L1 or L2 to open the door D1 or D2.

If, however, the piece of credential data CD is found not to designate an authorized user, the credential data receiver EAC1 or EAC2 is configured to refrain from causing an access grant message AG to be sent to any of the lock mechanisms L1 or L2.

Preferably, the reader units R, R1 and R2, the credential data receivers EAC, EAC1 and EAC2 and the control node N include, or are in communicative connection with at least one memory unit storing at least one computer program product, which contains software for performing the above-described actions when the computer program product is run on a processor of the reader units R, R1 and R2, the credential data receivers EAC, EAC1 and EAC2 and the control node N respectively.

Figure 7:
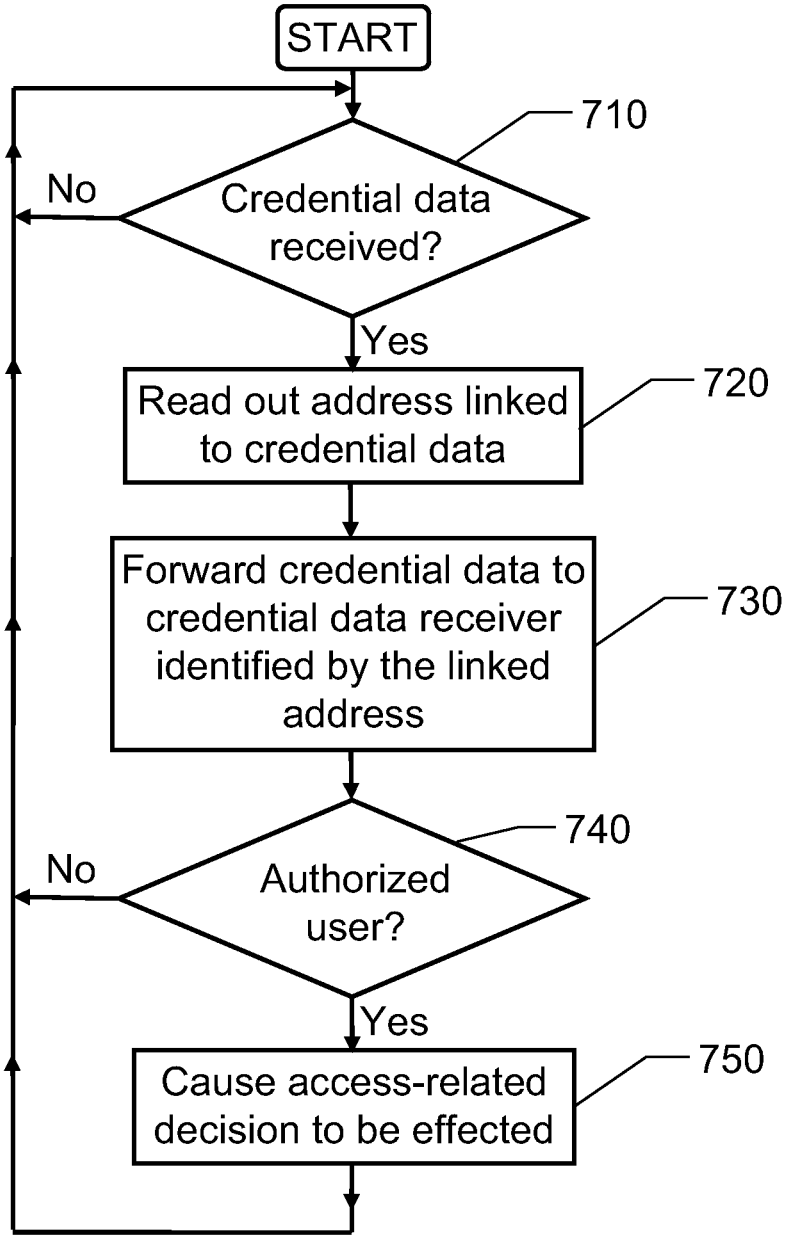
FIG. 7 illustrates, by means of a flow diagram, the general method according to the invention.

In order to sum up, we will now describe the general method executed by the proposed reader unit according to the invention with reference to the flow diagram in FIG. 7.

A first step 710 checks if credential data have been received, and if so a step 720 follows. Otherwise, the procedure loops back and stays in step 710.

Step 720 reads out the address linked to the credential data, either from a memory module associated with the reader unit or from a carrier for the credential data. Preferably, to maintain adequate security and reduce the risk of fraudulent manipulation, reading out the credential data from the carrier requires access to a first encryption key in the reader unit.

After having read out the credential data, a step 730 forwards the registered credential data to the credential data receiver identified by the address linked to the registered credential data. Again, for security reasons and to reduce the risk of fraudulent manipulation, access to a second encryption key (identical to or different from the first key) is preferably required in the reader unit to enable this transmission.

A subsequent step 740 determines whether or not the user associated with the credential data is authorized. From the reader unit's point-of-view this means waiting for an access decision from the credential data receiver. If such a decision arrives within a predefined time, for instance in the form of an access grant message, a step 750 follows. Analogous to the above, sending the access decision preferably also requires access to a third encryption key, such that the reader unit can be certain that a received access decision was issued by an authorized source, e.g. one of its associated credential data receivers.

If no access decision arrives within the predefined time, the procedure loops back to step 710.

In step 750, at least one access decision is effected in response to the access decision with respect to a well-defined space and the user being associated with the registered credential data. The access decision may involve granting access to the well-defined space, registering an entry to the well-defined space or registering an exit from the well-defined space.

After step 750, the procedure loops back to step 710.

It is worth noting that, although steps 710, 720 and 730 all mention "credential data", this does not mean that an exact copy of these specific data must be received, read out and forwarded respectively. Instead, various forms of data derived from the credential data may be received, read out and forwarded in and from the reader unit. Thus, the term "credential data" should here be regarded as a token being passed on from the carrier.

All of the process steps, as well as any sub-sequence of steps, described with reference to FIG. 7 above may be controlled by means of a programmed computer apparatus. Moreover, although the embodiments of the invention described above with reference to the drawings comprise a computer apparatus and processes performed in a computer apparatus, the invention thus also extends to computer programs, particularly computer programs on or in a carrier, adapted for putting the invention into practice. The program may be in the form of source code, object code, a code intermediate source and object code such as in partially compiled form, or in any other form suitable for use in the implementation of the process according to the invention. The program may either be a part of an operating system, or be a separate application. The carrier may be any entity or device capable of carrying the program. For example, the carrier may comprise a storage medium, such as a Flash memory, a ROM (Read Only Memory), for example a DVD (Digital Video/Versatile Disk), a CD (Compact Disc) or a semiconductor ROM, an EPROM (Erasable Programmable Read-Only Memory), an EEPROM (Electrically Erasable Programmable Read-Only Memory), or a magnetic recording medium, for example a floppy disc or hard disc. Further, the carrier may be a transmissible carrier such as an electrical or optical signal which may be conveyed via electrical or optical cable or by radio or by other means. When the program is embodied in a signal which may be conveyed directly by a cable or other device or means, the carrier may be constituted by such cable or device or means. Alternatively, the carrier may be an integrated circuit in which the program is embedded, the integrated circuit being adapted for performing, or for use in the performance of, the relevant processes.

The term "comprises/comprising" when used in this specification is taken to specify the presence of stated features, integers, steps or components. However, the term does not preclude the presence or addition of one or more additional features, integers, steps or components or groups thereof.

The invention is not restricted to the described embodiments in the figures, but may be varied freely within the scope of the claims.

The invention claimed is:

1. A reader unit configured to:

register credential data in respect of users seeking access to a well-defined space, communicate with an access-control-related building component associated with the well-defined space, and communicate with a first network-addressable credential data receiver operated by a first organization for causing at least one access decision in respect of the well-defined space to be effected, wherein the reader unit is further configured to:

communicate with at least one second network-addressable credential data receiver operated by a second organization different from the first organization for causing at least one access decision in respect of the well-defined space to be effected, and forward, via a communication network, each registered piece of credential data to either the first credential data receiver or a particular one of the at least one second credential data receiver based on an address linked to the piece of credential data which address identifies the first credential data receiver or the particular one of the at least one second credential data receiver by their respective network addresses, the linked address being stored in:

a memory module of the reader unit or on a carrier holding the piece of credential data which carrier is configured to be presented to the reader unit for registering the piece of credential data with the reader unit.

2. A data communication system comprising:

a reader unit configured to register credential data in respect of users seeking access to a well-defined space, an access-control-related building component associated with the reader unit and the well-defined space, and a first network-addressable credential data receiver configured to receive credential data registered by the reader unit and in response thereto cause at least one access decision in respect of the well-defined space to be effected based on a first set of user access rights stored in a first database, wherein the data communication system comprises at least one second network-addressable credential data receiver configured to receive credential data registered by the reader unit and in response thereto cause at least one access decision in respect of the well-defined space to be effected based on a second set of user access rights stored in a second database different from the first database, the reader unit is communicatively connected, via a communication network, to the first credential data receiver and the at least one second credential data receiver, and the reader unit is further configured to forward a registered piece of credential data to either the first credential data receiver or a particular one of the at least one second credential data receiver based on an address linked to the piece of credential data which address identifies the first credential data receiver or the particular one of the at least one second credential data receiver by their respective network addresses, the linked address being stored in:

a memory module of the reader unit or on a carrier holding the piece of credential data which carrier is configured to be presented to the reader unit for registering the piece of credential data.

3. The reader unit according to claim 1, wherein the at least one access decision involves granting or refusing access to the well-defined space, the access-control-related building component comprises a lock mechanism configured to selectively enable or prevent access to the well-defined space via a door associated with the reader unit, and in response to a received piece of credential data, each of the first and the at least one second credential data receiver is configured to:

if the piece of credential data is found by the first credential receiver within the first database to designate an authorized user, the first credential receiver causing an first access grant message to be sent to the lock mechanism ordering the lock mechanism to open the door, if the piece of credential data is found by the at least one second credential receiver within the second database to designate the authorized user, the at least one second credential reader causing an second access grant message to be sent to the lock mechanism ordering the lock mechanism to open the door, and otherwise refrain from causing either the first or second access grant message to be sent to the lock mechanism.

4. The reader unit according to claim 1, wherein the at least one access decision involves registering an entry to or exit from the well-defined space, and in response to a received piece of credential data, each of the first and the at least one second credential data receiver is configured to:

register an entry if the piece of credential data is received via a first scanner of the reader unit, and register an exit if the piece of credential data is received via a second scanner of the reader unit.

5. The data communication system according to claim 2, comprising a control node communicatively connected to the reader unit and each of the first and the at least one second credential data receiver, the control node being configured to:

receive credential data from the reader unit, forward the received credential data to a credential data receiver identified by the address linked to the credential data, receive access grant messages from the first and the at least one second credential data receiver, and forward the received access grant messages to the lock mechanism, each access grant message being configured to order the lock mechanism to be opened during a predetermined interval.

6. The data communication system according claim 5, wherein the control node is communicatively connected to at least one reader unit in addition to said reader unit, the control node being further configured to receive credential data from said additional reader unit, forward the received credential data to a credential data receiver identified by the address linked to the credential data, receive access grant messages from the first and the at least one second credential data receiver, and forward the received access grant messages to a lock mechanism in addition to said lock mechanism, each access grant message being configured to order the additional lock mechanism to be opened during a predetermined interval.

7. The data communication system according to claim 5, wherein the linked addresses identifying the first and the at least one second credential data receivers are Internet Protocol addresses.

8. A method of communicating data in a network comprising:

registering credential data in a reader unit, the credential data representing users seeking access to a well-defined space associated with the reader unit, forwarding any registered credential data to a network-addressable credential data receiver and in response thereto, effecting at least one access decision in respect of the well-defined space, wherein the network comprises a first network-addressable credential data receiver enforcing security policies of a first organization and at least one second network-addressable credential data receiver enforcing security policies of a second enterprise that is different from the first organization, and the method comprising forwarding, via a communication network, each registered piece of credential data to either the first credential data receiver or a particular one of the at least one second credential data receiver based on an address linked to the piece of credential data which address identifies the first credential data receiver or the particular one of the at least one second credential data receiver by their respective network addresses, the linked address being stored in:

a memory module of the reader unit or on a carrier holding the piece of credential data which carrier is configured to be presented to the reader unit for registering the piece of credential data.

9. The method according to claim 8, wherein in response to a received piece of credential data, in each of the first and the at least one second credential data receiver, the method comprising:

checking the piece of credential data against a respective database defining a set of users' access rights to the well-defined space, if the piece of credential data is found to designate an authorized user, causing an access grant message to be sent to a lock mechanism configured to selectively enable or prevent access to the well-defined space via a door associated with the reader unit, the access grant message being configured to order the lock mechanism to open the door, and otherwise refraining from causing the access grant message to be sent to the lock mechanism.

10. The method according to claim 8, wherein in response to a received piece of credential data, in each of the first and the at least one second credential data receiver, the method comprising:

registering an entry to the well-defined space if the piece of credential data is received via a first scanner of the reader unit, and registering an exit from the well-defined space if the piece of credential data is received via a second scanner of the reader unit.

11. The method according to claim 8, comprising:

receiving credential data from the reader unit in a control node, forwarding the received credential data from the control node to a credential data receiver identified by the address linked to the credential data, receiving, in the control node, access grant messages from the first and the at least one second credential data receiver, and forwarding the received access grant messages from the control node to the lock mechanism, each access grant message ordering the lock mechanism to be opened during a predetermined interval.

12. The method according to claim 8, wherein the linked addresses identifying the first and second credential data receivers are Internet Protocol addresses.

13. A computer program product loadable into the memory of a computer, the computer program product comprising software, which when executed on a computer:

registers credential data in a reader unit, the credential data representing users seeking access to a well-defined space associated to the reader unit, forwards, via a communication network, each registered piece of credential data to either a first network-addressable credential data receiver administered by a first organization or a particular one of at least one second networked-addressable credential data receiver administered by a second organization based on an address linked to the piece of credential data which address identifies the first credential data receiver or the particular one of the at least one second credential data receiver, the linked address being stored in a memory module of the reader unit or on a carrier holding the piece of credential data which carrier is configured to be presented to the reader unit for registering the piece of credential data, wherein each of said credential data receivers is configured to, in response to a piece of credential data, effect at least one access decision in respect of the well-defined space.

14. A computer readable medium, containing the computer program product according to claim 13.

15. The reader unit according to claim 2, wherein the at least one access decision involves granting or refusing access to the well-defined space, the access-control-related building component comprises a lock mechanism configured to selectively enable or prevent access to the well-defined space via a door associated with the reader unit, and in response to a received piece of credential data, each of the first and the at least one second credential data receiver is configured to:

check the piece of credential data against a database defining a set of users' access rights to the well-defined space, if the piece of credential data is found to designate an authorized user, causing an access grant message to be sent to the lock mechanism ordering the lock mechanism to open the door, and otherwise refrain from causing the access grant message to be sent to the lock mechanism.

16. The reader unit according to claim 2, wherein the at least one access decision involves registering an entry to or exit from the well-defined space, and in response to a received piece of credential data, each of the first and the at least one second credential data receiver is configured to:

register an entry if the piece of credential data is received via a first scanner of the reader unit, and register an exit if the piece of credential data is received via a second scanner of the reader unit.

17. The data communication system according to claim 6, wherein the linked addresses identifying the first and the at least one second credential data receivers are Internet Protocol addresses.

* * * * *